United States Patent [19]

Krautz et al.

[11] 4,388,746

[45] Jun. 21, 1983

[54] BUCKLE FOR A SAFETY BELT

[75] Inventors: Kurt Krautz, Rosengarten; Erhard Ender, Hamburg, both of Fed. Rep. of Germany

[73] Assignee: Autoflug-Stakupress GmbH & Co., Nordestedt, Fed. Rep. of Germany

[21] Appl. No.: 290,371

[22] Filed: Aug. 5, 1981

[30] Foreign Application Priority Data

Nov. 18, 1980 [EP] European Pat. Off. ..... 80107136.6

[51] Int. Cl.[3] ..... A44B 19/00

[52] U.S. Cl. ..... 24/230 A; 24/230 AL

[58] Field of Search ..... 24/230 A, 230 AL

[56] References Cited

U.S. PATENT DOCUMENTS

| | | | |
|---|---|---|---|
| 2,864,145 | 12/1958 | Elsner | 24/230 A |
| 3,165,806 | 1/1965 | Lehman | 24/230 A |
| 3,340,578 | 9/1967 | Straight et al. | 24/230 A |
| 4,237,586 | 12/1980 | Morinaga | 24/230 A |

*Primary Examiner*—Hugh R. Chamblee

*Attorney, Agent, or Firm*—Prutzman, Kalb, Chilton & Alix

[57] ABSTRACT

In a buckle for a safety belt, a pivotable latch (13–17) is arranged, relative to the push-in tongue (4), in such a way that the ejector force (11), or the belt force loading the tongue, urges the latch out of engagement. Provided to prevent this, in the closing position, is a securing device which, in one position (FIG. 1), holds the latch firmly in the latching position and, in another position (FIG. 2), releases the latch for opening. According to the invention, this securing device is designed as a pivoting lever (21), in order, on the one hand, to increase the degree of safety and, on the other hand, to lessen the opening force, at a moderate production outlay. The pivoting lever is mounted in such a way that it cannot leave the securing position even under shock stress from any direction whatever.

9 Claims, 4 Drawing Figures

BUCKLE FOR A SAFETY BELT

DESCRIPTION

Figure 1:
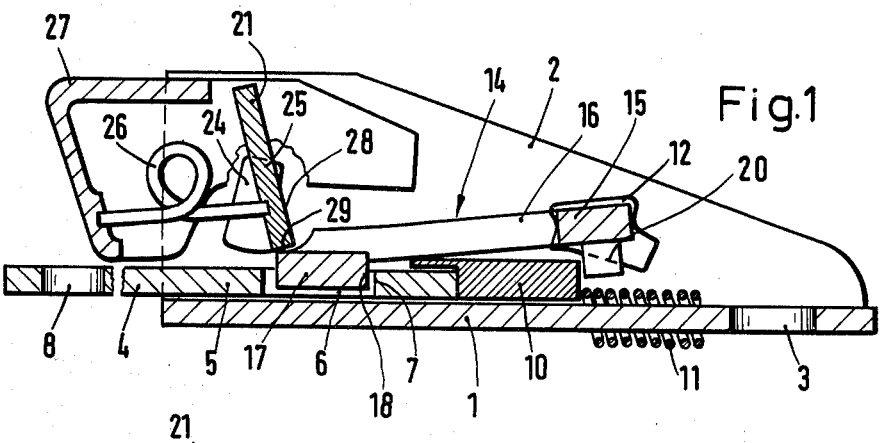

The invention relates to a buckle for a safety belt, consisting of a push-in tongue with a latching recess and of a lock with a push-in path for the push-in tongue, which is limited, at least on one side, by guide devices and is open at its front end and which contains an ejector spring, with a latch which is mounted pivotably in the lock and the pivot axis of which runs transversely to the direction of the push-in path and which forms a latch nose, which latch nose interacts with the latching recess of the push-in tongue and can be moved into the push-in path from the side remote from the guide devices and is arranged in such a way that, in the latching position, the ejector spring urges the latch out of engagement, and with a securing device for securing the latch in the latching position, which securing device is urged into the securing position by means of spring force and can be moved from this position to allow the lock to open.

A buckle of the type mentioned initially is known, in which the baseplate of a flat lock body limits the push-in path for the push-in tongue on the underside (U.S. Pat. No. 3,165,806). Mounted above it is a flat latch, which is mounted approximately in the middle of the lock by means of lateral projections in cut-outs of the side walls of the lock body, so as to be pivotable about a transverse axis, and the front end of which carries a downward-pointing nose, the rear face of which can interact in a latching manner with the recess of the push-in tongue. This front end of the lever is pressed downwards by a spring, in order to hold the latching nose in the push-in path. The rear end of this latch carries a handle. When this is lowered by means of hand pressure, the front end of the latch lifts, so that its nose is lifted out of the push-in path and the push-in tongue is released. In this case, the pivot axis of the latch is located above the push-in path. Consequently, the locking forces transmitted by the tongue to the latch in the direction of the push-in path lead to the formation of a torque on the latch, said torque stressing the latter in the opening direction. The spring which urges the latch into the closing position must, therefore, be very strong, resulting in the disadvantage that correspondingly high forces must also be applied to open the lock. For this reason, the arrangement described is generally avoided in favour of a geometry in which a torque stressing the latch in the latching direction is generated by the locking forces (German Auslegeschrift No. 1,557,412), or in which the locking forces remain neutral in respect of torque because the push-in path is located in the same plane as the pivot axis of the latch (U.S. Pat. No. 2,864,145). However, it is known that the lock arrangement described in the introduction is not completely useless, provided that, instead of the spring urging the latch into the closing position, there is a securing device which secures the latch positively in the latching position. In a known arrangement of this type, the securing device is constituted by a slide, which can be displaced parallel to the push-in path and which is urged by means of spring force into an end position in which it is immediately adjacent to a transverse face of the latch, so that the latter cannot escape from the latching position. The slide can be moved out of this position, by actuation by hand, against the spring force and then permits the latch to move out of the latching position, with the result that it is urged out of the latching position by the push-in tongue under the effect of an ejector spring located in the push-in path, and releases the push-in tongue (prior public use). However, this arrangement has the disadvantages that a substantial opening force is required and that the securing of the latch is not reliable under all circumstances. As is known, by opening force is meant that force which, after a loading of the lock by forces of the magnitude arising in an accident, is required to open the lock under a certain residual load. For example, certain automobile factories demand that the opening force should not exceed 50 N with a residual load of 0.5 kN, after the lock has been tested under forces which are comparable to those of an accident and which generally reach 16 to 18 kN. Because of the geometrical arrangement presupposed in the introduction, the securing device must assume a certain component of the latch load. Such a component is still effective even under residual load and, in the securing slide of the known arrangement, causes a double frictional force, namely, on the one hand, between the slide and the latch and, on the other hand, between the slide and its guide in the housing. Since the guide in the housing is produced by stamping and thus cannot have a high surface quality, and, in addition, can be damaged by the previous accident loading, the result is a considerable opening force. Regarding the other disadvantage of the known arrangement, namely that the securing of the latch is not guaranteed under all circumstances, it must be said that, depending on the type of guide in the housing, the slide can become tilted a little and, therefore, under certain circumstances does not assume its securing position relative to the latch over its full width. It can then happen that, under the accident loading, the latch lifts out of the push-in path on the insufficiently secured side and then subsequently displaces the securing device on the other side also. This disadvantage can be eliminated only by means of a very high-quality construction.

The object of the invention is to provide a buckle of the type mentioned in the introduction, which combines a low opening force and a high degree of reliability at a normal production outlay. The solution according to the invention resides in the fact that the securing device is a pivoting lever.

By means of this measure, the friction between the securing device, namely the pivoting lever, on the one hand, and the lock body, on the other hand, is reduced to a negligible amount. Consequently, the total opening force is approximately halved. Tilting of the pivoting lever need not be feared, since the pivot bearings can easily be designed so that they do not permit any tilting of the lever.

Appropriately, the pivot axis of the latch lies behind the latching nose, on that side of the push-in path which is remote from the guide devices.

Furthermore, it is advantageous if the latch has, near its end carrying the latching nose, a securing face which lies transversely to the direction of movement of said latch and which, in the latching state, interacts with a nose of the pivoting lever. Stepped offsetting of this securing face makes it possible to release the lock by pivoting the pivoting lever through only a small angle, until it is guided away over the edge of the step and thereby releases the latch.

So that the pivoting lever can be actuated more easily to release the lock, it is appropriately made double-armed, and it is connected to a handle at its end which does not interact with the latch. A very simple design is obtained, if the handle is a slide guided approximately parallel to the push-in path, because the pivoting lever then does not need to be shaped at an angle. However, an angled design is, of course, possible, if the handle is to be actuated transversely to the push-in path in order to release the lock.

Figure 2:
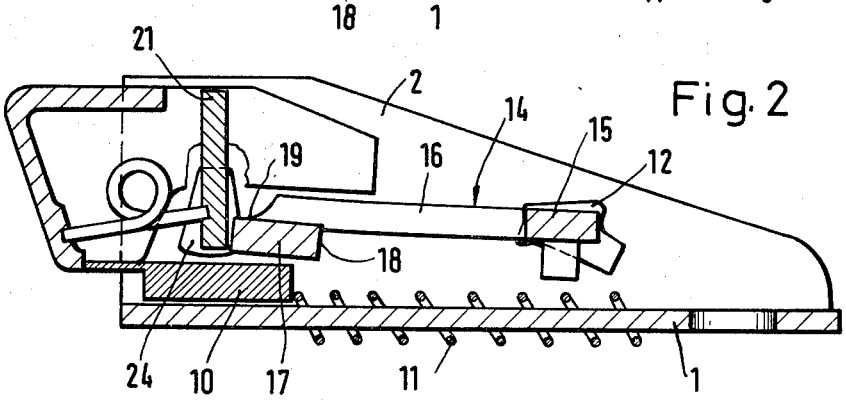
Figure 3:
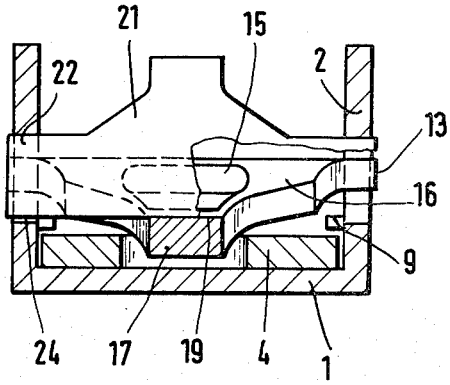
Figure 4:
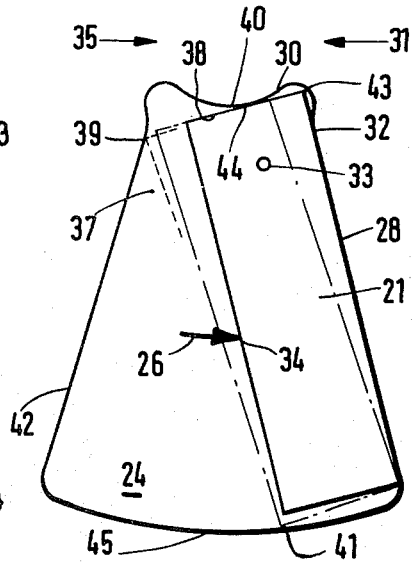

The invention is described in more detail below with reference to the drawing which illustrates an advantageous exemplary embodiment and in which:

FIGS. 1 and 2 show longitudinal sections at different stages of operation, FIG. 3 shows a cross-section in the region of the pivoting lever, and FIG. 4 shows a partial representation of a lateral bearing projection of the pivoting lever, with the associated bearing cut-out.

The lock body consists of a flat base 1 and of two side walls 2 which rise vertically from its parallel margins and which are connected rigidly to the base. The lock body is U-shaped in cross-section. Its base 1 contains a bore 3 for fastening an anchoring piece.

The base 1 and the side walls 2 constitute the lower and lateral limitations of the push-in path for the push-in tongue 4, the front part 5 of which has approximately the width of the push-in path between the side walls 2, so as to be guided securely therein. This push-in tongue has a latching recess 6 which forms a latching face at 7. At its rear end, it is provided, in a known way, with a recess 8 to receive a belt loop. The push-in path is limited, at the top, by projections 9 connected rigidly to the lock body. The known covering of the lock body by a plastic housing is not represented, for the sake of simplicity. (All directional indications such as "upward", "to the right", "clockwise direction", etc, relate to the illustration in FIGS. 1 and 2.)

The lock contains, in the push-in path, an ejector plate 10, which is guided therein, in a way not shown, to move in the direction of the push-in path and which is stressed against the push-in direction by means of a spring 11 guided in slots of the base. Thus, the push-in path can be recognised in FIGS. 1 to 3 by the topside of the base 1 and by the bearings of the push-in tongue 4 and of the ejector plate 10, and by the projections 9.

A cut-out 12 to receive lateral projections 13 of a latch plate 14 is located at matching points in the two side walls 2, in the rear half (that is to say, on the right half in the drawing) of the lock body. Sufficient play exists between the cut-out 12 and the associated projections 13 for the latch plate 14 to pivot through a small angle about an axis lying transversely to the push-in direction and parallel to the base 1. The two end positions which occur in practice when the device is operated are illustrated in FIGS. 1 and 2. The latch plate consists of a rear crosspiece 15 connecting the projections 13 and of two arms 16 which lead forwards from said crosspiece and which carry, at the front, a downward-projecting latch part 17 forming a latch nose 18 pointing to the rear. The latch part 17 projects forwards a little relative to the arms 16, so that a free face 19, limited at the front by its front edge, is formed on the topside of said latch part. In the latching state (FIG. 1), this face lies in the upper limiting plane of the push-in path or a little above it.

The latch plate 14 has, at its rear end, one or more projections 20, which project downwards near the axis of rotation of the latch plate, fixed by the front end of the cut-out 12, and which limit the push-in path to the rear. They serve, together with the ejector plate 10, for the positive latching of the push-in tongue. In fact, when pushed in to the rear against the pressure of the spring 11, said push-in tongue moves the ejector plate 10, which ejector plate 10 is made so long that it just butts against the projections 20, thereby causing the latch to rotate to the left in an anti-clockwise direction, when the latching face 7 of the push-in tongue 4 has just passed through under the latch nose 18 of the latch part 17.

In the latching state, the latch nose 18 of the latch part 17 is approximately perpendicular to the direction of the push-in path and at an obtuse angle to the connecting line with the axis of the latch. When a force is exerted to the left on the latch nose 18 in the direction of the push-in path, for example by a belt force acting on the push-in tongue or by the ejector spring 11, a torque, which is formed by the force acting in the push-in path and the distance of the push-in path from the axis of rotation of the latch, as a lever arm, is consequently exerted on the latch. This torque seeks to rotate the latch in a clockwise direction, to lift the latch part 17 out of the latch recess of the push-in tongue and, thus, to release the latching. In the latching state, this is prevented by the pivoting lever 21. This pivoting lever 21 is located above the upward-pointing face 19 of the latching part 17. It is designed as a plate which extends transversely in the lock body and the outline of which can be seen on the left in FIG. 3, whilst on the right it is partly cut away to expose the latch plate. The pivoting lever is mounted in cut-outs 24 of the side walls 2 by means of its lateral projections 22, so that there arises the axis of rotation, the region of which is indicated at 25 (FIG. 1) and which is parallel to the axis of rotation of the latch 13–17. Consequently, it can be pivoted at least between the two end positions illustrated in FIGS. 1 and 2. Serving for pivoting are, on the one hand, a spring 26 which endeavours to pivot it in an anti-clockwise direction and, on the other hand, the slide 27, which is guided so that it can move parallel to the push-in path, in the lock body, in a way not shown, and which, when moved to the right, butts against the upper end of the pivoting lever and thereby rotates the pivoting lever in a clockwise direction. In the securing position, the pivoting lever 21 is held, on the one hand, by the spring 26. On the other hand, however, it is appropriately arranged in such a way that, in the case of loading, it is prevented by self-locking from moving out of the securing position. This self-locking can be achieved, for example, by locating the pivot axis 25 a little to the left (in the drawing) of a perpendicular line drawn to the securing face 19. In the weakly loaded or unloaded state, the pivot axis 25 of the pivoting lever is formed by a pivoting fulcrum 32 at the rear (right-hand) limiting edge of the bearing cut-out 24, this limiting edge being designed as a concave rounding, projection or roof-shaped edge, on which the pivoting lever 21 rolls or tilts with low friction. However, in the loaded state, the upper limiting edge 30 of the bearing cut-out determines the axis of rotation. This edge is, likewise, designed as a concave rounding or edge, with a central point 40 projecting the furthest.

The spring 26 is appropriately designed in such a way that it is supported, at one end, on the lower part of the pivoting lever and, at the other end, on the slide 27. As a result, both parts are urged into their normal position by a double action. It can, of course, be designed otherwise than is illustrated in the drawing.

Above the region located between the projections 22, the pivoting lever is designed with as little material as possible. Only in the centre does it reach the full height necessary for interaction with the slide 27. This serves not only to save weight, but also, for reasons to be explained later, to locate the centre of gravity in the lower region of the pivoting lever.

The arrangement described functions as follows.

In the released state of the lock (FIG. 2), the ejector plate 10 is located, in the push-in path, under the latch part 17 of the latch, so that the latter cannot block the push-in path. It is therefore possible to move the push-in tongue 5 to the right into the push-in path, the ejector plate 10 being likewise pushed to the right. When the ejector plate 10 reaches the projections 20, the latching recess 6 of the push-in tongue 4 is located underneath the latch part 17. During further movement, the latch is pivoted in an anti-clockwise direction as a result of the butting of the ejector plate 10 on the projections 20, so that the latch part 17 must penetrate into the latching recess 6.

In the released state of the lock, the lower end of the pivoting lever 21 bears under prestress on the forward-pointing nose of the latch part 17 as a result of the spring force 26. At the moment when said latch part drops into the latching recess of the push-in tongue, said nose slides under the pivoting latch, so that the latter can rotate, under the effect of the spring 26, in an anti-clockwise direction, until it comes to rest on the rear limitation 28 of the bearing cut-outs 24 (FIG. 1). At this juncture, the downward-pointing nose 29 of the pivoting lever 21 is located immediately above the upward-pointing face 19 of the latch part. In this position, in which the pivoting latch is held by the spring 26, it secures the latch 13–17 in the latching position.

In the latching state, the latching face 7 of the push-in tongue 4 exerts on the latch nose 18 of the latch part 17 a force which is directed to the left in the direction of the push-in path and the line of application of which runs in the push-in path and, consequently, at a certain distance underneath the pivot axis of the latch 13–17, fixed by the cut-outs 12. If the latch were not secured in its position by the pivoting lever 21, a torque would therefore be applied to the latch 13–17 in a clockwise direction, which torque would urge the latter out of the latching position into the opening position. The geometrical proportions are chosen so that this torque is sufficient, on its own, to open the latch under the effect of the ejector spring 11.

If the slide 27 is now moved to the right to open the lock, the pivoting lever 21 is rotated in a clockwise direction, as a result of which, when clearing the front edge of the latch part 17, it loses its effect on the securing face 19. The latch is thereby freed and can move upwards under the effect of the forces acting in the push-in tongue or in the ejector plate, and can thereby release the push-in tongue.

In the case of loading, the pivoting lever 21 has to absorb a certain component of the tongue load. The magnitude of this component depends on the ratio of the distance of the pivot axis of the latch 13–17 from the middle of the push-in path to the distance of the pivot axis of the latch 13–17 from the latch nose 18. The ratio of these distances is generally between approximately 1:2 and 1:10, and preferably in the region of 1:3. This means that, for example, one-third of the tongue load is transmitted to the pivoting lever 21. This fraction is so small, and the interacting faces 19 and 29 of the latch and of the pivoting lever respectively can easily be made so large, that no deformation takes place on these faces even under the strongest load occurring in practice. Consequently, the friction in this region is very low even after loading. The opening force required is correspondingly small. On the other hand, deformation can occur in the pivot bearings of the pivoting lever 21 in the walls 2 of the lock body, because the interacting faces of the projections 22 and of the bearing cut-outs 24 (faces 30) are essentially smaller there. However, these faces can be designed so that, even in the case of a certain deformation, practically no pivoting resistance occurs, due to the fact that the upper limiting edge 30 (FIGS. 4 and 5) of the bearing cut-out 24 is made convexly round or projecting downwards in a roofshape, so that the associated face of the pivoting lever can roll thereon.

It is not absolutely necessary for the latch face 18 of the latch part 17 to run, in the latching state, exactly perpendicularly to the direction of the push-in path, in the way described above. It is important only that its direction in relation to the position of the pivoting point of the latch should be such that the torque transferring the latch into the release position is formed when the pivoting lever is moved into the releasing position (FIG. 2). In other words, the tangent at the point of contact between the latch nose 18 and the latching face 7 must intersect at right angles, outside the push-in path, with a radius projecting from the pivoting point of the latch, the acute angle in the right triangle, which is formed by this point of intersection, the pivoting point of the latch and the point of contact, being larger than the angle of friction at the point of contact.

The reliability of the lock under extreme stress depends, among other things, on the fact that the pivoting lever maintains its latching position (FIG. 1) even under shock-like loading of the lock from any direction whatever. This may be explained with reference to FIG. 4 which illustrates the pivoting lever in the latching position.

When a shock acts upon the housing in the direction of the arrow 31, the pivoting lever 21 is supported by the rear limiting edge 28 of the bearing cut-out 24. This rear limitation ends, at the top, at the point 32 designated as a pivoting fulcrum for the pivoting lever 21. If the centre of gravity 33 of the pivoting lever 21 were to be located substantially above the pivoting fulcrum 32, the danger would exist that the pivoting lever would rotate in a clockwise direction under the acceleration 31 and would, as a result, move out of the securing position. This danger is avoided by locating the centre of gravity 33 near the pivoting fulcrum 32, so that the effect of the spring 26 is, in any case, stronger than any counteracting torque which may arise. Preferably, the centre of gravity 33 is even located somewhat underneath the pivoting fulcrum 32. So that the spring 26 can better fulfil its securing function, its point of engagement 34 is appropriately provided underneath the pivoting fulcrum 32.

A shock acting in the direction 35 is more dangerous. If the lever 21 were to be supported against such a shock at that point 39 of the bearing cut-out which lies opposite the point 32, it would be subjected, because of the lower centre of gravity 33, to a torque acting in a clockwise direction and, if the spring force 26 does not predominate, endeavouring to turn said lever out of the securing position. In most cases, this is prevented, according to the invention, due to the fact that considerable play 37 is provided in the bearing cut-out 24 on the side lying opposite the pivoting fulcrum 32, so that the pivoting lever is supported, on the left front side, at least initially, only on the spring 26 at its point of engagement 34. Since this point of engagement is located underneath the centre of gravity 33, there arises, under the shock 35, a torque which acts on the pivoting lever in an anti-clockwise direction and which moves the latter, at the top, to the left into the region of the play 37, during which time its centre of rotation is located on the end lying opposite its bearing face 38, usually at the corner 41, by means of which it is supported on the securing face 19 of the latch. During this movement, the shock stress, which generally lasts for only a very brief period, may already have passed its dangerous peak. An amount of play 37 of the order of half the thickness of the pivoting lever is sufficient in most cases.

In the case of a strong shock stress 35, the upper latch part will move to the left until it is prevented from further movement by a limitation of the cut-out 24. If this is the point 39 on the left limiting edge 42 of the bearing cut-out 24 (position of the pivoting lever shown by broken lines), the point 39 constitutes a new fulcrum for the pivoting lever in respect of the forces applied. Since the centre of gravity 33 is located lower, a torque, which endeavours to turn the lower end of the pivoting lever out of the securing position, now acts in a clockwise direction. During this time, the upper right-hand corner 43, or a point located near this, of the upper bearing face 38 of the pivoting lever, comes to rest on the upper limiting edge 30 of the bearing cut-out, generally at that point 40 of said limiting edge which projects the furthest. If the bearing cut-out is not high enough, it may also happen that the upper left-hand edge of the pivoting lever does not reach the left limiting edge 42 of the bearing cut-out 24 at all, but, instead, the pivoting of the pivoting lever in an anti-clockwise direction, according to the representation in dot-and-dash lines, is stopped, because its upper bearing face 38 is caught, at its point 44, on a far-projecting point 40 of the upper limitation 30 of the bearing cut-out 24.

The bearing points 39, and at 40, then represent new fulcrums for the pivoting lever, which are located higher than its centre of gravity 33 and which, consequently, give rise to the formation of a torque in a clockwise direction, by means of which that lower end of the pivoting lever which secures the latch could be turned out of the securing position.

This is prevented, according to the invention, due to the fact that the height of the bearing cut-out 24 between the point 40, at which the upper bearing face 38 of the pivoting lever comes to rest, and the opposite limiting edge 45 is less than the dimension of the pivoting latch between the bearing point 43 or 44 and its lower left-hand edge 41. The result of the measure is, namely, that, in the case of the feared pivoting of the pivoting lever in a clockwise direction about the points 40, 43 or 44, the lower edge 41 of the pivoting lever very soon butts against the lower limiting edge 45 of the bearing cut-out, as a result of which this movement is immediately terminated. It is, of course, necessary to ensure, when this happens, that, by suitable dimensioning of the bearing cut-out and of the pivoting lever, this movement is terminated before the lower face of the pivoting lever has left the securing face 19 of the latch.

A conclusion emerges from this functional discription, regarding the dimensioning of the play 37 for the case of an essentially symmetrical design of the bearing cut-out 24. In this case, it is appropriate, namely, that, when the pivoting lever is initially pivoted in an anti-clockwise direction under the shock stress 35, its upper bearing face 38 reaches the point 40, projecting furthest, of the upper limitation 30 of the cut-out as near as possible to its upper right-hand corner 43, so that the full diagonal dimension of the bearing projection of the pivoting lever, in relation to the height of the cut-out, can be used for securing purposes. This aim is achieved when the play 37 (measured in the direction of the pivoting movement of the upper left-hand corner of the projection of the pivoting lever) amounts approximately to half the thickness of the pivoting lever.

We claim:

1. A buckle for a safety belt comprising a linear push-in tongue with a latching recess and a lock with a linear push-in path for the push-in tongue having an opening at a front end thereof for receiving the tongue and guide devices for guiding the tongue inwardly along the path, the lock having an ejector spring for urging the tongue outwardly along the path, a pivotal latch having a pivot axis which extends transversely to the direction of the linear push-in path and a latch nose pivotal into the push-in path to interact with the latching recess of the tongue to latch the tongue therein and so that in a pivotal latching position of the latch nose in which it latches the tongue within said path, the ejector spring urges the latch nose pivotally outwardly from the latching recess of the tongue, a pivotal securing device having a pivotal securing position for securing the pivotal latch in its pivotal latching position, and a spring with a spring force pivotally urging the securing device to its pivotal securing position, the securing device being pivotal from its securing position to allow the lock to open.

2. Buckle according to claim 1, characterised in that the pivot axis (bearing cut-out 12) of the latch lies behind the latching nose (18), on that side of the push-in path which is remote from the guide devices (1).

3. Buckle according to claim 1 or 2, characterised in that the latch (13–17) has, near its end carrying the latching nose (18), a securing face (19) which lies transversely to the direction of movement of said latch and which, in the latching state, interacts with a nose of the pivoting lever (21).

4. Buckle according to one of claims 1 or 2, characterised in that the pivoting lever (21) is made doublearmed and is connected to a handle (27) at its end which does not interact with the latch (13–17).

5. Buckle according to claim 4, characterised in that the handle is a slide (27) guided approximately parallel to the push-in path.

6. Buckle according to one of claims 1 or 2, characterised in that the bearing cut-outs (24) for the pivoting lever (21) each form a pivoting fulcrum (32) at their rear limiting edge (28) near the centre of gravity (33) of the pivoting lever.

7. Buckle according to claim 6, characterised in that the centre of gravity (33) of the pivoting lever (21) is located lower than the pivoting fulcrum (32) and higher than the point of engagement (34) of the spring (26), and the bearing cut-out (24) has a large amount of play (37) on the side lying opposite the pivoting fulcrum (32).

8. Buckle according to claim 7, characterised in that the amount of the play (37) is between 1/5 and 4/5 of the thickness of the bearing projection of the pivoting lever.

9. Buckle according to claim 7, characterised in that the height of the bearing cut-out (24) between that region (40) of its limitation (30), on which the bearing face (38) of the pivoting lever comes to rest when it is pivoted out of its securing position about a point far from its bearing face (38), and the opposite limitation (45) of the bearing cut-out is less than the diagonal dimension of the bearing projection of the pivoting lever.

* * * * *